US010427182B2

(12) United States Patent
Huang

(10) Patent No.: US 10,427,182 B2
(45) Date of Patent: Oct. 1, 2019

(54) ATOMIZING NOZZLE STRUCTURE WITH FILTERING ASSEMBLY

(71) Applicant: Yu Chiung Huang, Taichung (TW)

(72) Inventor: Yu Chiung Huang, Taichung (TW)

( * ) Notice: Subject to any disclaimer, the term of this patent is extended or adjusted under 35 U.S.C. 154(b) by 256 days.

(21) Appl. No.: 15/025,323

(22) PCT Filed: Jul. 28, 2014

(86) PCT No.: PCT/CN2014/083145
§ 371 (c)(1),
(2) Date: Mar. 28, 2016

(87) PCT Pub. No.: WO2016/015202
PCT Pub. Date: Feb. 4, 2016

(65) Prior Publication Data
US 2018/0281008 A1 Oct. 4, 2018

(51) Int. Cl.
*B05B 15/40* (2018.01)
*B05B 1/30* (2006.01)

(52) U.S. Cl.
CPC ..... *B05B 15/40* (2018.02); *B05B 1/3006* (2013.01)

(58) Field of Classification Search
CPC .. B05B 1/12; B05B 1/14; B05B 15/40; B05B 1/3006
See application file for complete search history.

(56) References Cited

U.S. PATENT DOCUMENTS 1,982,228 A * 11/1934 Murphy ..... F23D 11/383 239/462
2,572,606 A * 10/1951 Fisher ..... F23D 11/26 239/464
2,643,915 A * 6/1953 Bruno ..... F23D 11/38 137/543.17
2,954,172 A * 9/1960 Grundman ..... F23D 11/24 137/109
2,981,483 A * 4/1961 Pichon ..... F23D 11/26 239/455
3,154,095 A * 10/1964 Cleminshaw ..... F23D 11/10 137/469
3,443,760 A * 5/1969 Simmons ..... F23D 11/26 239/403

(Continued)

*Primary Examiner* — Chee-Chong Lee
*Assistant Examiner* — Steven M Cernoch
(74) *Attorney, Agent, or Firm* — Charles E. Baxley

(57) ABSTRACT

An atomizing nozzle structure comprises a first body, a second body and a cover combined in order serially to form a combination, wherein a chamber is formed in an inner axial direction of the combination; and a rotor, an anti-leakage assembly and a filtering assembly mounted in the chamber in order. The filtering assembly is a combination of a core and a filter. The core has an embedding portion and a closing portion on two ends, respectively. A hollow portion connects the embedding portion to the closing portion. An air passage is formed in an axial inner portion of the embedding portion. Grooves are formed on a circumferential side surface of the closing portion. The filter is mounted in the hollow portion. The embedding portion is inserted into one end of the second body. Thus, the filtering assembly is combined with the second body by way of insertion, so that the filtering assembly can be stably positioned to facilitate the disassembly for replacement or cleaning.

7 Claims, 6 Drawing Sheets

(56) References Cited

U.S. PATENT DOCUMENTS 3,746,038 A * 7/1973 Simmons ..... F02C 7/228 137/513.5
3,804,333 A * 4/1974 Kramer ..... F23G 7/05 239/124
3,948,444 A * 4/1976 Reed ..... B05B 1/3405 239/11
4,128,206 A * 12/1978 Bintner ..... B05B 1/042 239/11
4,491,272 A * 1/1985 Bradley ..... F23D 11/26 239/104
4,649,950 A * 3/1987 Bradley ..... B01D 35/04 137/549
4,798,330 A * 1/1989 Mancini ..... F23D 11/10 239/125
5,002,230 A * 3/1991 Norskov ..... B05B 1/3006 137/513.5
5,799,871 A * 9/1998 Theurer ..... F23D 11/26 137/510
6,394,366 B1 * 5/2002 Adams ..... B05B 1/3442 239/463
6,415,994 B1 * 7/2002 Boggs ..... B05B 1/3415 239/463
7,387,681 B2 * 6/2008 Matsunaga ..... B05B 9/005 118/300
7,464,885 B1 * 12/2008 Chang ..... B05B 1/3013 239/463
7,971,804 B2 * 7/2011 Roberts ..... F16K 43/006 239/204
8,057,220 B2 * 11/2011 Bretz ..... B05B 7/066 239/406
8,460,422 B2 * 6/2013 McClure ..... F01N 3/0256 123/467
2010/0072300 A1 * 3/2010 Miller ..... B05B 9/0861 239/332
2012/0193455 A1 * 8/2012 Morgan ..... B05B 1/3426 239/468
2015/0158037 A1 * 6/2015 Huang ..... B05B 1/34 239/462

* cited by examiner

ATOMIZING NOZZLE STRUCTURE WITH FILTERING ASSEMBLY

This application is a national application of PCT-application PCT/CN 2014/083145 filed on Jul. 28, 2014.

BACKGROUND OF THE INVENTION

Field of the Invention

The invention relates to the technical field of a liquid micro-atomization device, and more particularly to an atomizing nozzle connected to a liquid conduit and having a filter.

Description of the Related Art

The main function of an atomizing nozzle is to atomize a liquid flowing therethrough. Thus, either the aperture of the spray hole or the channel gap, through which the liquid flows, is very small, and the water impurities or scale can easily congest the spray hole or water flowing channel, so that the atomizing nozzle fails or has the dripping condition when not being used. One solution is to replace or clean the atomizing nozzle. Another solution is to dispose a filtering assembly in the atomizing nozzle to filter out the impurities of the water.

Typically, a filter core made of a ceramic or plasticizing material can be applied to the atomizing nozzle. The filter core has the micro holes for separating the impurities from the liquid flowing therethrough. Because the filter core has the small volume, the surface of the filter core is full of impurities rapidly, so that the filtering effect is deteriorated, or even the congestion condition occurs.

In addition, the filter core is usually positioned inside the body by way of screwing and thus needed to be threaded using the additional manufacturing processes. Furthermore, the small volume of the body makes the manufacturing processes of the thread become inconvenient.

SUMMARY OF THE INVENTION

An object of the invention is to provide an atomizing nozzle structure having a filtering assembly and possessing the simple structure and the effect of easily mounting.

Another object of the invention is to provide an atomizing nozzle structure with a filtering assembly that can be stably positioned and can be taken out and replaced or cleaned conveniently.

To achieve the above-identified objects and effects, the invention discloses an atomizing nozzle comprising a first body, a second body and a cover combined in order and in series to form a combination, wherein a chamber is formed in an inner axial direction of the combination; and a rotor, an anti-leakage assembly and a filtering assembly mounted in the chamber in order, wherein the filtering assembly is a combination of a core and a filter. One end of the core has an embedding portion, the other end of the core has a closing portion, and a hollow portion connects the embedding portion to the closing portion. Also, an air passage is formed in an axial inner portion of the embedding portion, grooves are formed on a circumferential side surface of the closing portion, the filter is mounted in the hollow portion, and the embedding portion is inserted into one end of the second body.

Therefore, using the filtering assembly can effectively filter out the impurities of the liquid, and can make the atomizing nozzle spray smoothly. The filtering assembly is combined with the second body by way of insertion, so that the filtering assembly can be stably positioned, taken out conveniently for replacement or cleaning.

The following description is made with reference to the accompanying drawings according to the objects and effects of the invention.

DETAILED DESCRIPTION OF THE INVENTION

Figure 1:
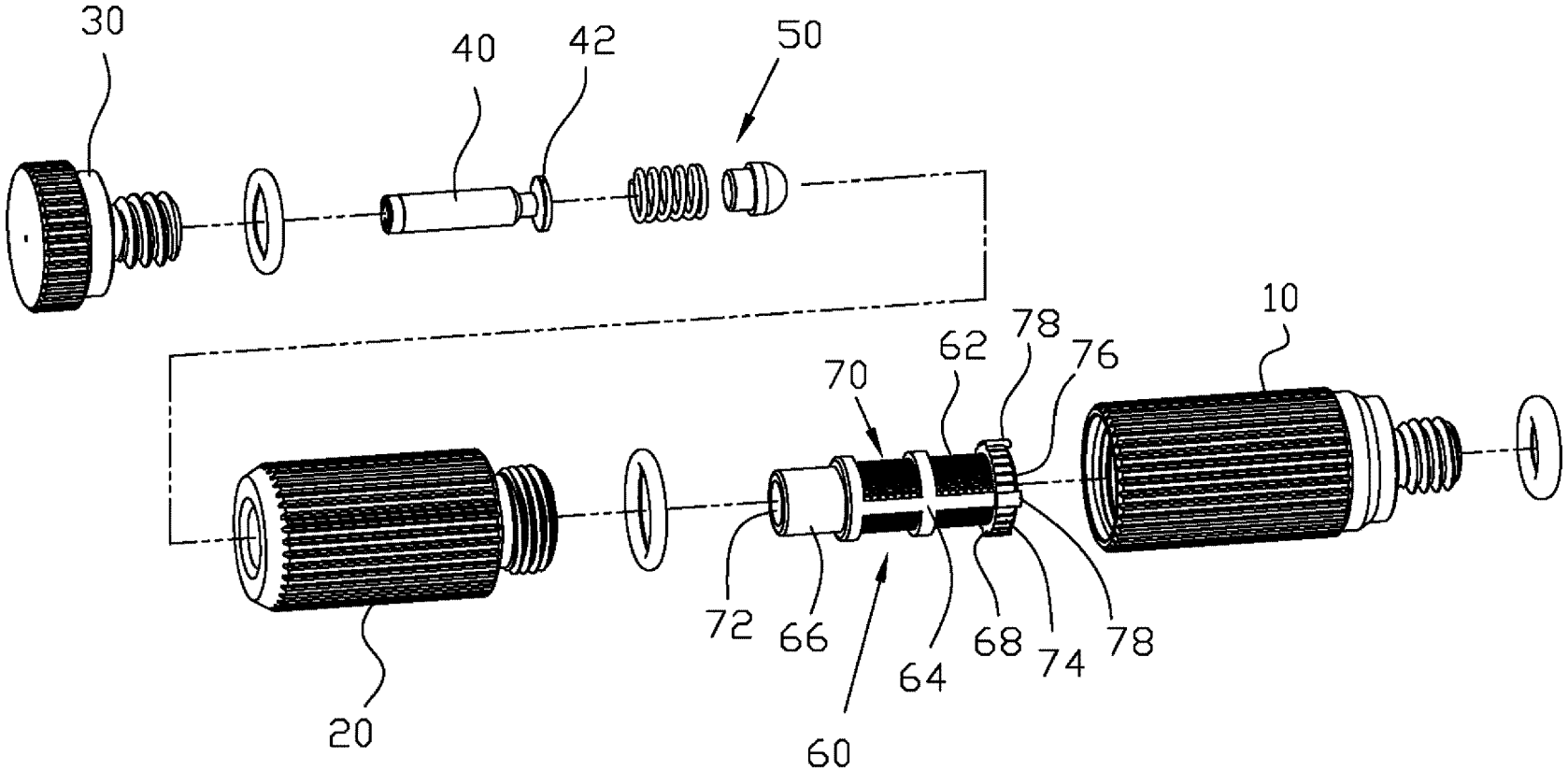
FIG. 1 is an exploded view showing a first embodiment of the invention.

Referring to FIG. 1, an atomizing nozzle comprises a first body (10) axially and serially connected to a second body (20), and a cover (30) serially connected to one end of the second body (20). Next, a rotor (40), an anti-leakage assembly (50) and a filtering assembly (60) are mounted in an axial inner portion of the combination formed by the first body (10), the second body (20) and the cover (30).

Figure 2:
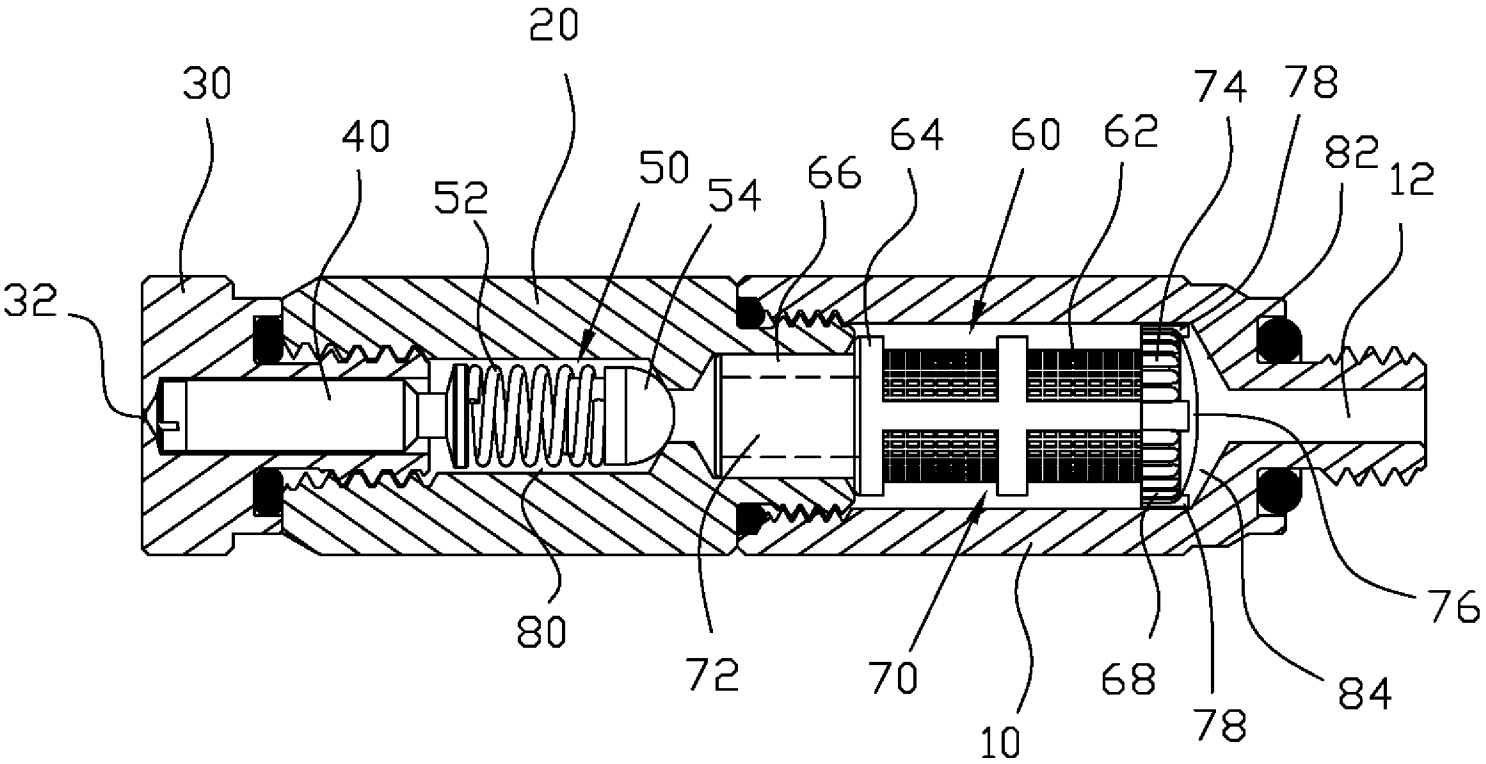
FIG. 2 is a schematic view showing an assembled structure of the first embodiment of the invention.

Referring to FIG. 2, the axial inner portion of the combination formed by the first body (10), the second body (20) and the cover (30) is formed with a chamber (80). One end of the first body (10) has an inlet (12), an end surface of the cover (30) has a spout (32), and the chamber (80) connects the inlet (12) to the spout (32). Also, a broadening opening (82) communicating with the inlet (12) is formed on one end of the chamber (80). The rotor (40), the anti-leakage assembly (50) and the filtering assembly (60) are mounted in the chamber (80).

Furthermore, the rotor (40) is mounted in the chamber (80), and one end of the rotor (40) is disposed opposite the spout (32). The anti-leakage assembly (50) comprises a spring (52) and a plug (54). The anti-leakage assembly (50) is mounted in the chamber (80) and disposed between the rotor (40) and the filtering assembly (60). One end of the filtering assembly (60) corresponds to the broadening opening (82).

Referring to FIGS. 1 and 2, the filtering assembly (60) is a combination of a filter (62) and a core (64). One end of the core (64) has an embedding portion (66), and the other end of the core (64) has a closing portion (68), wherein a hollow portion (70) connects the embedding portion (66) to the closing portion (68). Also, an air passage (72) is formed in an axial inner portion of the embedding portion (66), and grooves (74) are formed on a circumferential side surface of the closing portion (68). The filter (62) is mounted in the hollow portion (70). Next, an end surface (76) of the closing portion (68) of the core (64) is formed with an arc structure; and a circumferential side of the closing portion (68) has a plurality of feet (78). Each foot (78) extends from the circumferential side of the closing portion (68), and one end of each foot (78) protrudes from the end surface (76) of the closing portion (68).

Referring again to FIG. 2, the embedding portion (66) of the filtering assembly (60) is to be inserted into one end of the second body (20), and one end of each foot (78) rests against the broadening opening (82), so that a gap (84) is formed between the end surface (76) of the closing portion (68) and a wall surface of the broadening opening (82).

Figure 3:
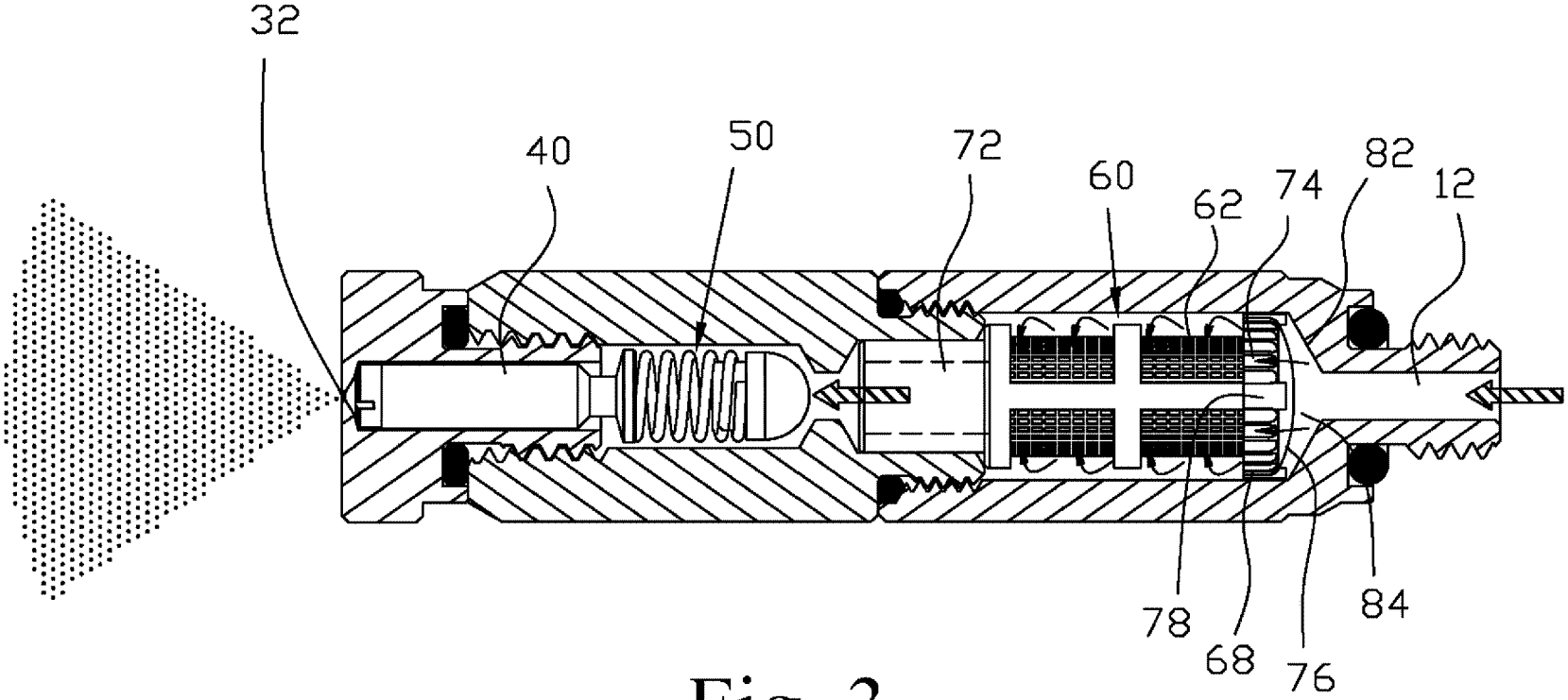
FIG. 3 is a schematic view showing a used state of the first embodiment of the invention.

Referring to FIG. 3, after the liquid enters the inlet (12), the liquid can smoothly flow through each groove (74), and thus flow through the meshes of the filter (62) and enter the axial inner portion of the filter (62) so that the filter (62) can filter out the impurities contained in the liquid because the gap (84) is formed between the end surface (76) of the closing portion (68) and the wall surface of the broadening opening (82). The filtered liquid flowing out of the air passage (72) of the filtering assembly (60) can push the anti-leakage assembly (50), so that the liquid can flow forward and through the rotor (40), and can be finally sprayed from the spout (32) to enter a water mist state.

Thus, the filtering assembly (60) with the filter (62) can provide the good filtering effect using the meshes. In addition, the filtering assembly (60) is combined with the second body (20) by way of insertion, so the user conveniently removes and cleans it. In addition, one end of each foot (78) rests against the wall surface of the broadening opening (82), so the filtering assembly (60) can be stably positioned.

Referring again to FIG. 1, one end of the rotor (40) according to the first embodiment of the invention extends to form a stop portion (42) for resting against the anti-leakage assembly (50).

Figure 4:
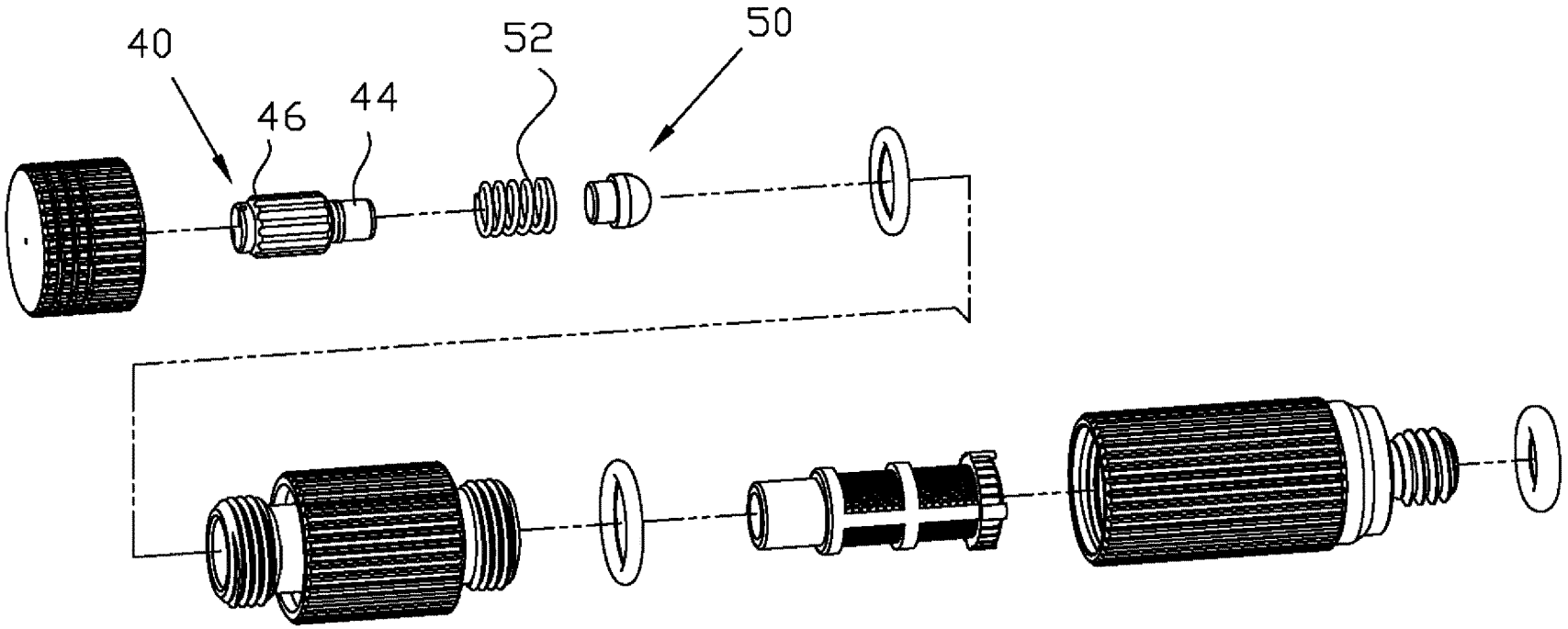
FIG. 4 is an exploded view showing a second embodiment of the invention.

Referring to FIG. 4, one end of the rotor (40) extends to form an axle portion (44), and the surface of the rotor (40) has a plurality of parallel ribs (46). The axle portion (44) is to be combined with the spring (52) of the anti-leakage assembly (50).

Figure 5:
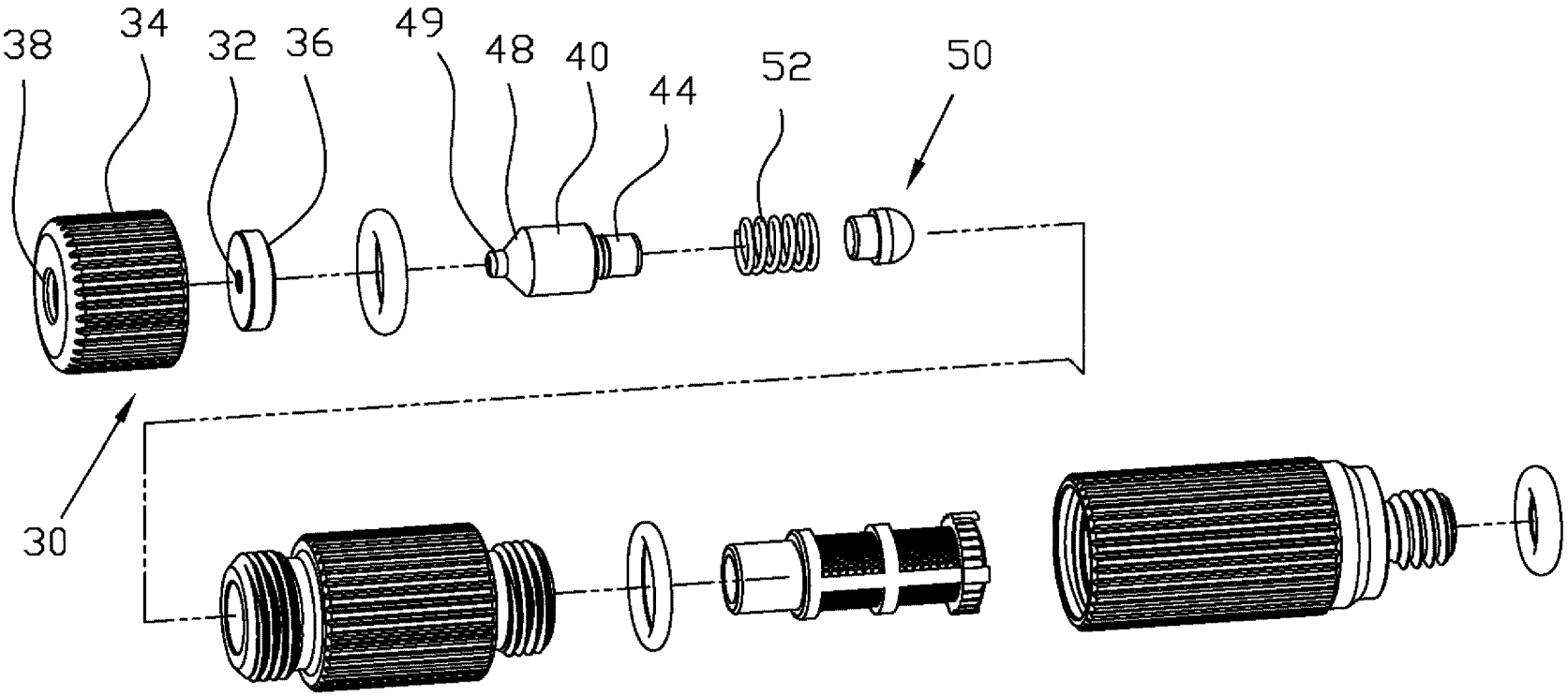
FIG. 5 is an exploded view showing a third embodiment of the invention.

Referring to FIG. 5, one end of the rotor (40) extends to form an axle portion (44), the other end of the rotor (40) has a tapered portion (48), and an end surface of the tapered portion (48) has a post (49). The axle portion (44) is to be combined with the spring (52) of the anti-leakage assembly (50). Also, the cover (30) comprises a cover body (34) combined with a pad body (36). One end of the cover body (34) has a through hole (38), the pad body (36) has the penetrating spout (32), the pad body (36) is mounted in the cover body (34), and the spout (32) corresponds to the through hole (38).

Figure 6:
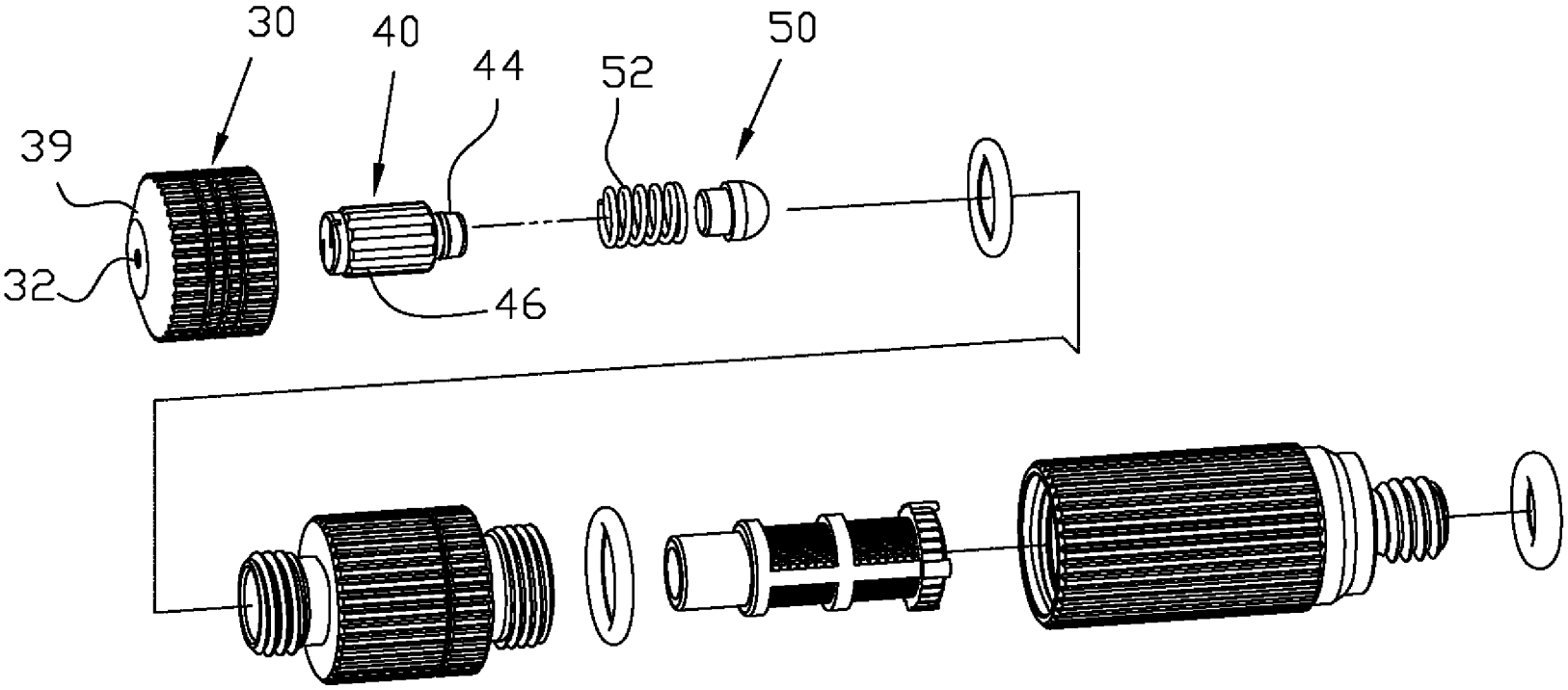
FIG. 6 is an exploded view showing a fourth embodiment of the invention.

Referring to FIG. 6, one end of the cover (30) is formed with a convex portion (39), and the spout (32) is disposed on the convex portion (39). Also, one end of the rotor (40) extends to form an axle portion (44), the surface of the rotor (40) has a plurality of parallel ribs (46), wherein the axle portion (44) is to be combined with the spring (52) of the anti-leakage assembly (50).

While the present invention has been described by way of examples and in terms of preferred embodiments, it is to be understood that the present invention is not limited thereto. To the contrary, it is intended to cover various modifications. Therefore, the scope of the appended claims should be accorded the broadest interpretation so as to encompass all such modifications.

What is claimed is:

1. An atomizing nozzle structure for generating and spraying a micro-atomized liquid, the atomizing nozzle structure comprising:

a first body having one end having an inlet;

a second body serially connected to the first body;

a cover, which is serially connected to the second body and has a spout;

a chamber formed in an axial inner portion of a combination of the first body, the second body and the cover;

a broadening opening formed on one end of the chamber and communicating with the inlet;

a filtering assembly mounted in the chamber, wherein the filtering assembly is a combination of a core and a filter, one end of the core has an embedding portion, which is a tubular member projected from the core, the other end of the core has a closing portion, which is a disk-like member connected to the core, a hollow portion connects the embedding portion to the closing portion, an air passage is formed in an axial inner portion of the embedding portion, a plurality of grooves are formed on a circumferential side surface of the closing portion, the filter is mounted in the hollow portion, the embedding portion is inserted into one end of the second body, and the closing portion is disposed opposite the broadening opening;

a rotor mounted in the chamber, wherein one end of the rotor is disposed opposite the spout;

an anti-leakage assembly mounted in the chamber and disposed between the rotor and the filtering assembly; and a plurality of feet each extending from a circumferential side of the closing portion, wherein one end of each of the feet protrudes from an end surface of the closing portion and is for resting against the broadening opening, so that a gap is formed between the end surface of the closing portion and a wall surface of the broadening opening;

wherein liquid enters the first body via the inlet and flows to the filter through the gap and the grooves of the closing portion.

2. The atomizing nozzle structure according to claim 1, wherein an end surface of the closing portion of the core is formed with an arc structure.

3. The atomizing nozzle structure according to claim 1, wherein one end of the rotor extends to form a stop portion for resting against the anti-leakage assembly.

4. The atomizing nozzle structure according to claim 1, wherein one end of the rotor extends to form an axle portion, a surface of the rotor has a plurality of parallel ribs, and the axle portion is combined with the anti-leakage assembly.

5. The atomizing nozzle structure according to claim 1, wherein one end of the rotor extends to form an axle portion, the other end of the rotor has a tapered portion, an end surface of the tapered portion has a post, and the axle portion is combined with the anti-leakage assembly.

6. The atomizing nozzle structure according to claim 1, wherein the cover comprises a cover body combined with a pad body, one end of the cover body has a through hole, the pad body has the penetrating spout, the pad body is mounted in the cover body, and the spout corresponds to the through hole.

7. The atomizing nozzle structure according to claim 1, wherein one end of the cover is formed with a convex portion, and the spout is disposed on the convex portion.

* * * * *